US008226352B2

(12) United States Patent
Gutierrez et al.

(10) Patent No.: US 8,226,352 B2
(45) Date of Patent: Jul. 24, 2012

(54) "O" HEAD DESIGN

(75) Inventors: Jose Ramon Gutierrez, Huntington Beach, CA (US); Richard J. O'Donnell, Whittier, CA (US); Timothy Michael Dach, Alhambra, CA (US); Steven Edwin Webster, Monrovia, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 655 days.

(21) Appl. No.: 12/353,704

(22) Filed: Jan. 14, 2009

(65) Prior Publication Data

US 2009/0180874 A1 Jul. 16, 2009

Related U.S. Application Data

(60) Provisional application No. 61/020,902, filed on Jan. 14, 2008.

(51) Int. Cl.
*F04D 29/64* (2006.01)

(52) U.S. Cl. ..... 415/112; 415/225

(58) Field of Classification Search ..... 415/56.2, 415/108, 109, 121.1, 121.2, 215.1, 225, 226
See application file for complete search history.

(56) References Cited

U.S. PATENT DOCUMENTS

| | | | | |
|---|---|---|---|---|
| 1,525,737 | A | 2/1925 | Hollander | |
| 2,005,699 | A | 6/1935 | Gottwald | |
| 2,673,636 | A | 3/1954 | Vermette | |
| 3,294,038 | A | 12/1966 | Rossi | |
| 3,526,934 | A | 9/1970 | Owen, Sr. | |
| 3,733,151 | A * | 5/1973 | Timmons et al. | 417/423.8 |
| 3,780,639 | A | 12/1973 | Wood | |
| 4,004,766 | A | 1/1977 | Long | 248/55 |
| 4,063,849 | A * | 12/1977 | Modianos | 415/210.1 |
| 4,146,203 | A | 3/1979 | Williams | 248/62 |
| 4,770,601 | A * | 9/1988 | Crisafulli | 415/109 |
| 5,017,104 | A | 5/1991 | Baker et al. | 417/423.12 |
| D319,966 | S | 9/1991 | Ellison | D8/382 |
| 5,213,468 | A | 5/1993 | Sexton et al. | 415/121.3 |

(Continued)

FOREIGN PATENT DOCUMENTS

| | | |
|---|---|---|
| CL | 47114 | 4/2006 |

(Continued)

OTHER PUBLICATIONS

Fairbanks Morse Pump, Vertical Turbine Solids Handling Pumps, Assembly 10" Thru 30" VTSH Above Ground Discharge, drawing No. VTSHA009, rev. 1, Dec. 1, 1998, 1 page.

(Continued)

*Primary Examiner* — Stephen W Smoot

(57) ABSTRACT

A discharge head features a motor mounting plate configured for mounting on a motor; a base plate configured for mounting on a pump assembly; an elbow transition mounted on the base plate configured for providing discharge from the pump assembly; a seal housing pipe coupled to the elbow transition configured for receiving a mechanical seal or packing arrangement; supporting pipes arranged between the motor mounting plate and the base plate; and ribs arranged between the supporting pipes and the seal housing pipe configured to prevent substantially lateral and torsional movement, including movement due to reacting hydraulic forces at a pump nozzle and inertia from a driver. The discharge head according to the present invention makes it quicker and easier to couple together the shaft of a pump and the shaft of a motor in such VTSH pumps when compared to the techniques known in the art.

11 Claims, 7 Drawing Sheets

U.S. PATENT DOCUMENTS

| | | | | |
|---|---|---|---|---|
| 5,489,188 | A | 2/1996 | Meyer et al. | 415/119 |
| D379,584 | S | 6/1997 | Lindquist | D8/380 |
| D414,405 | S | 9/1999 | Tompkins | D8/396 |
| 6,089,823 | A * | 7/2000 | Cronin et al. | 415/121.1 |
| D491,443 | S | 6/2004 | Lowery | D8/354 |
| 6,991,362 | B1 * | 1/2006 | Seaman | 366/168.2 |
| D548,056 | S | 8/2007 | Erickson et al. | D8/354 |

FOREIGN PATENT DOCUMENTS

| | | |
|---|---|---|
| CL | 1428-06 | 5/2007 |

OTHER PUBLICATIONS

International Search Report of the International Searching Authority issued in PCT/US2009/030955 (filed Jan. 14, 2009) on Apr. 7, 2009 (8 pages).

English language abstract for CL47114 (application No. 0065-2005) (1 page), Apr. 2006.

English language abstract for 1428-2006 (Chile) (1 page), May 2007.

* cited by examiner

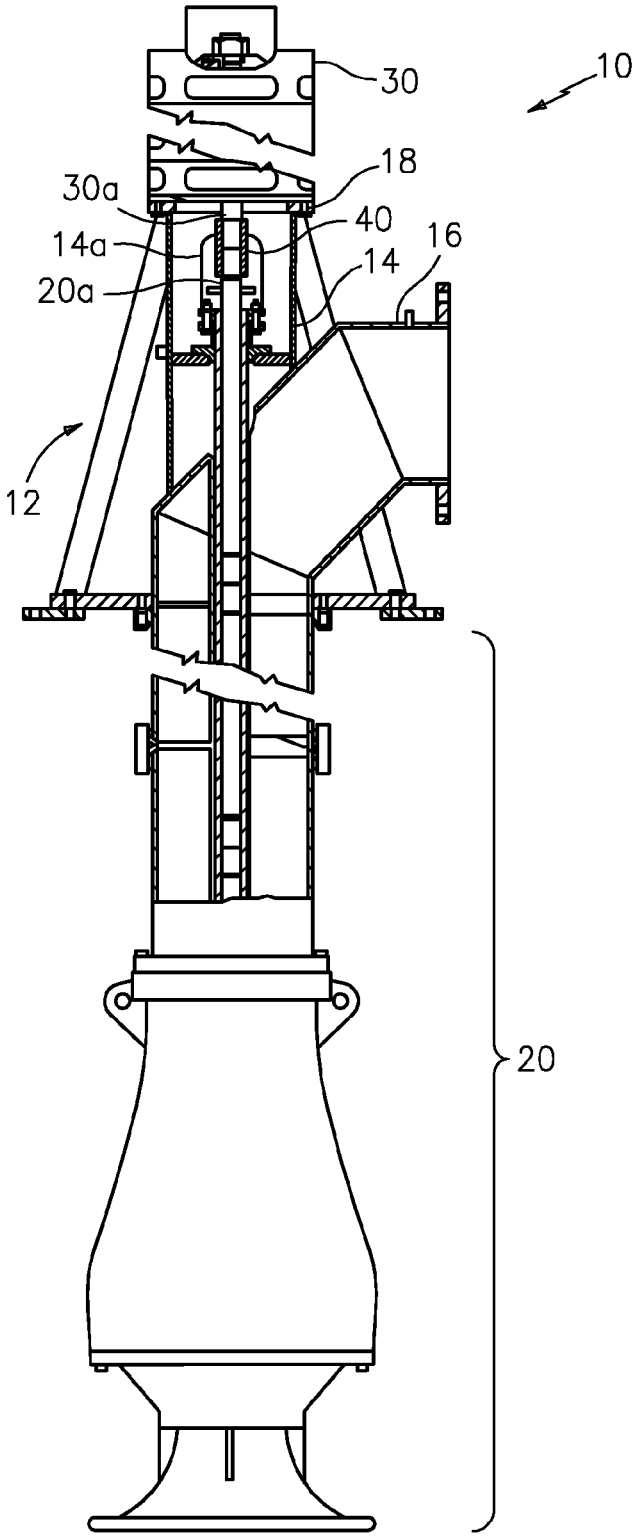
FIG. 2a
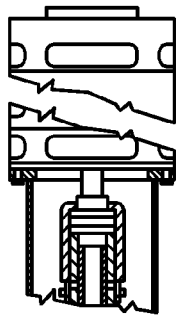
FIG. 2b
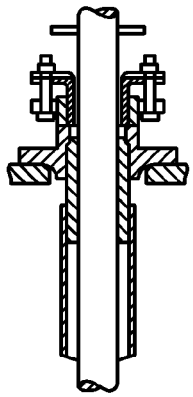
FIG. 2c
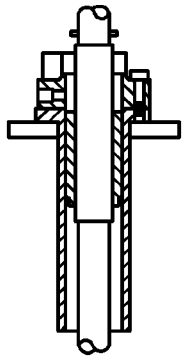
FIG. 2d
FIG. 2
(PRIOR ART)

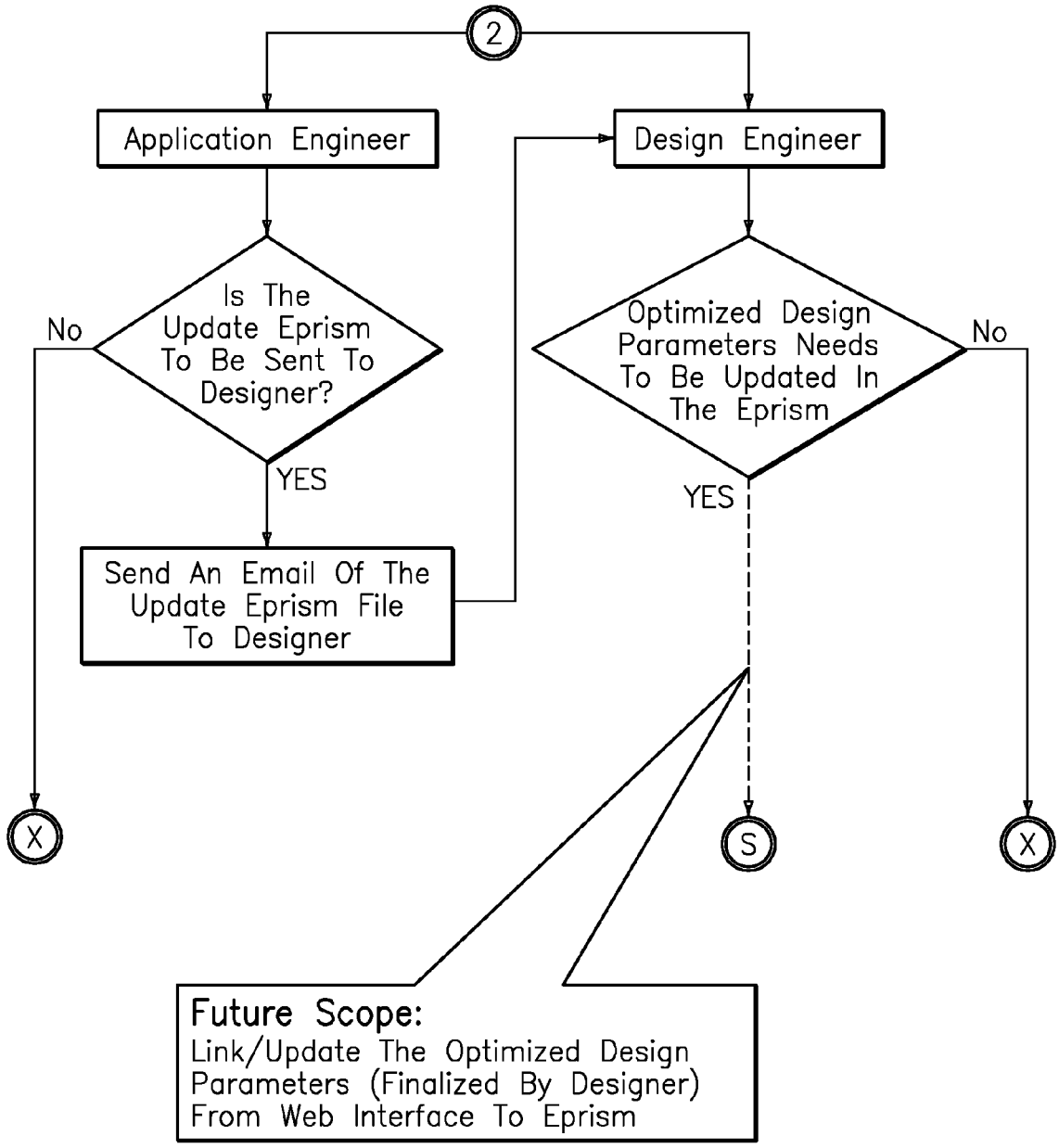
*FIG. 6c*
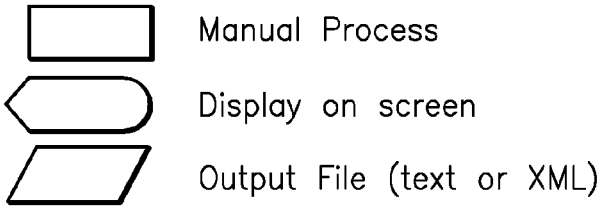
*FIG. 6D*: The Key

"O" HEAD DESIGN

CROSS-REFERENCE TO RELATED APPLICATIONS

This application claims benefit to provisional patent application Ser. No. 61/020,902, filed 14 Jan. 2008, which is hereby incorporated by reference in its entirety.

BACKGROUND OF THE INVENTION 1. Field of the Invention

The present invention relates to a discharge head; and more particularly to a discharge head for a multistage vertical pump at high pressure, including vertical turbine solids handling (VTSH) pumps. 2. Brief Description of Related Art VTSH pumps are known in the art which operate in an upright position and employ a bowl assembly including a rotary impeller submerged in a body of liquid or fluid to be pumped having entrained stringy material and other solids. VTSH pumps are typically more efficient over a broad capacity range than conventional solids-handling pumps, and can be used with a wide variety of standard above-ground drives, thus eliminating the need for submersible drives.

By way of example, FIGS. 1 and 2 show a known VTSH pump assembly by Fairbanks Morse Pumps, where FIG. 1 shows a diagram of a known vertical turbine solids handling (VTSH) pumps assembly generally indicated as 10 by Fairbanks Morse Pumps, where FIGS. 2*a* to 2*d* show a drawing of the known VTSH pump assembly shown in FIG. 1. In general, the VTSH pump 10 has a head 12 coupled between a pump generally indicated as 20 to a motor 30. In general, as shown the pump includes insolids-handling impellers with blunt, well-rounded leading vanes and a thick hydrofoil shape to ensure passage of large solids and long stringy materials; the discharge diffuser has three symmetrically arranged well-rounded vanes which serve to balance the radial hydraulic forces and eliminate the radial load of the impeller; the suction bell has four guide vanes to streamline flow entering the impeller and the absence of a tail bearing eliminates any obstruction to the debris flowing to the impeller; the entire length of the column is furnished with an internal vertical splitter plate aligned with the vertical exits of the bowl vane; the splitter plate continues into the discharge connection, preventing trash accumulation on the shaft-enclosing tube; either a surface or underground discharge connection can be provided; and lineshaft and bearings are fully enclosed, separately lubricated and isolated from the pumped liquid. In particular, the head 12 has a seal housing pipe 14 coupled between an elbow transition 16 and a mounting plate 18 for seating the motor 20; and the seal housing pipe 14 has a diametrically-opposing openings 14*a* for allowing the coupling of the shaft 20*a* of the pump 20 and the shaft 30*a* of the motor 30 using a coupling 40. One disadvantage of this VTSH pump design, is that the seal housing pipe 14 makes it difficult to couple together the shaft 20*a* of the pump 20 and the shaft 30*a* of the motor 30 using the coupling 40.

Other VTSH pumps are also known, including U.S. Pat. Nos. 4,063,849 and 5,496,150, where the '849 patent discloses a discharge pump having a discharge elbow with diametrically-opposing openings, and where the '150 patent discloses a VTSH pump having a discharge elbow 30 without any such diametrically-opposing openings.

There is a need in the industry for a VTSH pump design that makes it quicker and easier to couple together the shaft of a pump and the shaft of a motor.

SUMMARY OF THE INVENTION

The present invention provides a new and unique discharge head featuring a motor mounting plate configured for mounting on or to a motor; a base plate configured for mounting on or to a pump assembly; an elbow transition mounted on the base plate configured for providing discharge from the pump assembly; a seal housing pipe coupled to the elbow transition configured for receiving a mechanical seal or packing arrangement; supporting pipes arranged between the motor mounting plate and the base plate; and ribs arranged between the supporting pipes and the seal housing pipe configured to prevent substantially lateral and torsional movement, including movement due to reacting hydraulic forces at a pump nozzle and inertia from a driver.

The discharge head according to the present invention makes it quicker and easier to couple together the shaft of a pump and the shaft of a motor in such VTSH pumps when compared to the techniques known in the art.

According to some embodiments of the present invention, the discharge head may include one or more of the features, as follows:

The supporting pipes may include a configuration with 4 supporting pipes to support the vertical motor weight, torque, pump downthrust and nozzle forces and moments. The scope of the invention is not intended to be limited to the number of supporting pipes. For example, embodiments are envisioned within the scope of the invention that include more or less than 4 supporting pipes.

The discharge head may be configured to provide 360 degree access to the coupling and seal housing.

The discharge head may be configured to provide twice the nozzles loads per API610 standard, including API610-$8^{Th}$ and $10^{Th}$ Ed., so as to provide discharge head stiffness to withstand API forces and moments.

The discharge head may be configured to form part of a multistage vertical pump at high pressure.

The discharge head may be configured to have a shorter 3-mitered elbow without welding ribs to support forces and moments than conventional elbows.

The discharge head may be configured to have a shorten height length so as to improve the overall pump vibration due to less cantilever distance from the foundation to the motor top bearing.

The discharge head may be configured to have less overall vibration amplitude achieved from a max relative movement of about 0.003" between the seal housing pipe and the motor mounting plate.

The mounting plate, base plate, elbow transition, seal housing pipe, supporting pipe and additional ribs of the discharge head may be configured to have an optimized design configuration, the dimensions of which are generated by performing a structural static and dynamic analysis for specific design conditions that defines a specific configuration using parametric design of the discharge head.

The discharge head may be configured to have a smaller seal housing pipe than the known housing pipes and dimensioned so as to reduce the amount of hydraulic losses, better hydraulic pressure distribution in the elbow transition and facilitates the installation of the mechanical seal or packing arrangement. The discharge head may be configured to have a smaller base plate area, such that the pipe support angle is around 80° versus 60 to 70° from known competitor's device used for high pressure pump applications.

The discharge head may be configured to have a minimum pipe support deflection by performing Finite Element Analysis (FEA) during its design to evaluate pipe deflection optimizing the required cross-section.

The additional ribs may include 4 additional ribs connected from the pipe supports to the seal housing pipe. The scope of the invention is not intended to be limited to the number of additional ribs. For example, embodiments are envisioned within the scope of the invention that include more or less than 4 additional ribs.

The discharge head may be configured without external ribs, since the natural frequency is controlled by performing Finite Element Analysis (FEA) during its design and varying the wall thickness of the elbow transition and pipe supports cross section.

The elbow transition may be configured with a discharge flange weld having butt-weld connection. The scope of the invention is not intended to be limited to the type or kind of weld connection. For example, embodiments are envisioned within the scope of the invention that include using other types or kinds of weld connection.

The present invention provides an increase motor stand structure stiffness for about 2 times API nozzle loads and maximum nozzle flange rating pressure with a maximum relative movement of about 0.003" between the seal housing and the motor support plate. The current conventional design for the same size analyzed has about 0.012" relative movement using 1 times API nozzle loads.

Moreover, in the present invention every component may be custom engineered using Finite Element Analysis (FEA) based on an optimized parametric model for multiple discharge head/motor stand sizes which did not exist before. A person skilled in the art would appreciate that techniques for Finite Element Analysis are known in the art, and the scope of the present invention is not intended to be limited to the use of any particular type or kind of Finite Element Analysis either now known or later developed in the future.

BRIEF DESCRIPTION OF THE DRAWING

The drawing includes the following Figures:

FIG. 2, including FIGS. 2*a* to 2*d*, shows an assembly drawing of the known vertical turbine solids handling (VTSH) pumps assembly shown in FIG. 1.

FIG. 5, including FIG. 5*c* is a cross-sectional view of mounting detail shown in FIG. 5*b* along lines B-B, and where FIG. 5*d* is a cross-sectional view of sealing detail shown in FIG. 5*c* along lines C-C.

FIG. 6, including FIGS. 6*a*-6*d*, show an optimization automation process chart, where FIGS. 6*a*-6*c* show the steps of the optimization automation process, and where FIG. 6*d* shows a key related to details set forth in the steps of FIGS. 6*a*-6*c*.

DETAILED DESCRIPTION OF THE INVENTION

Figure 1:
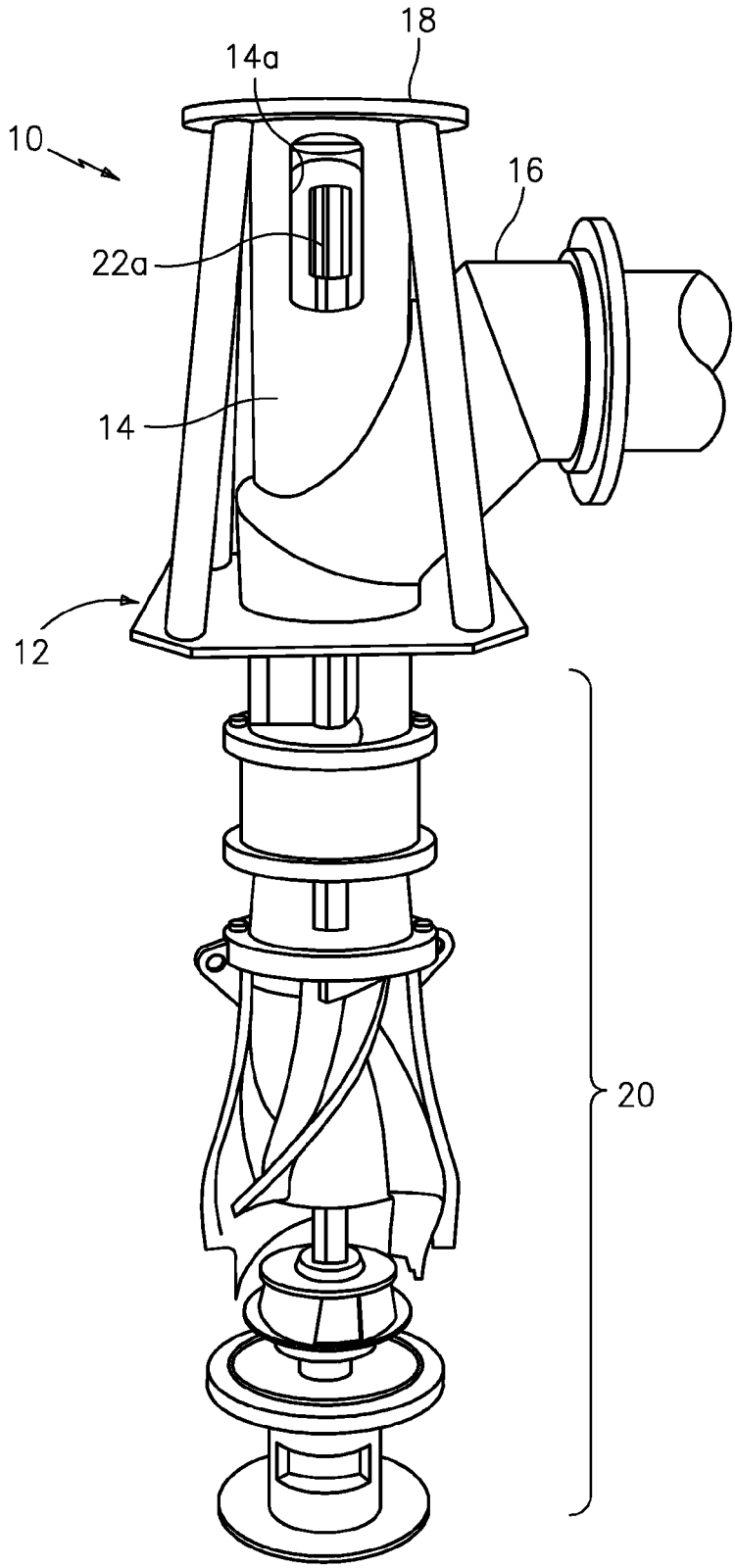
FIG. 1 (PRIOR ART)
FIG. 1 shows a diagram of a known vertical turbine solids handling (VTSH) pumps assembly by Fairbanks Morse Pumps.
Figure 3:
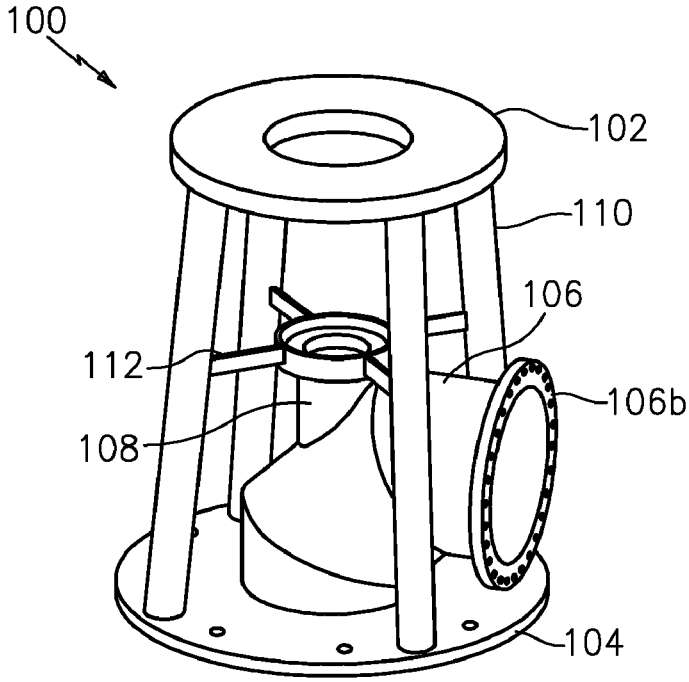
FIG. 3 is a diagram of an "O" head design according to some embodiments of the present invention.
Figure 4:
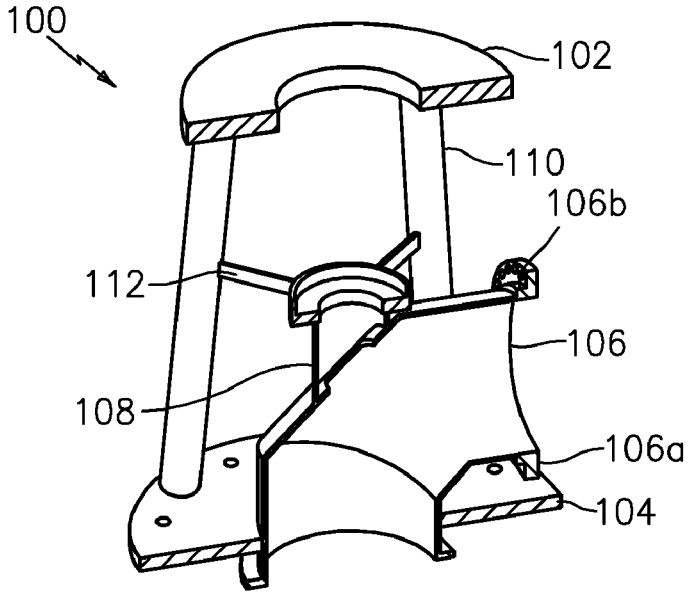
FIG. 4 is a cross-sectional diagram of the "O" head design shown in FIG. 3.
Figure 5A:
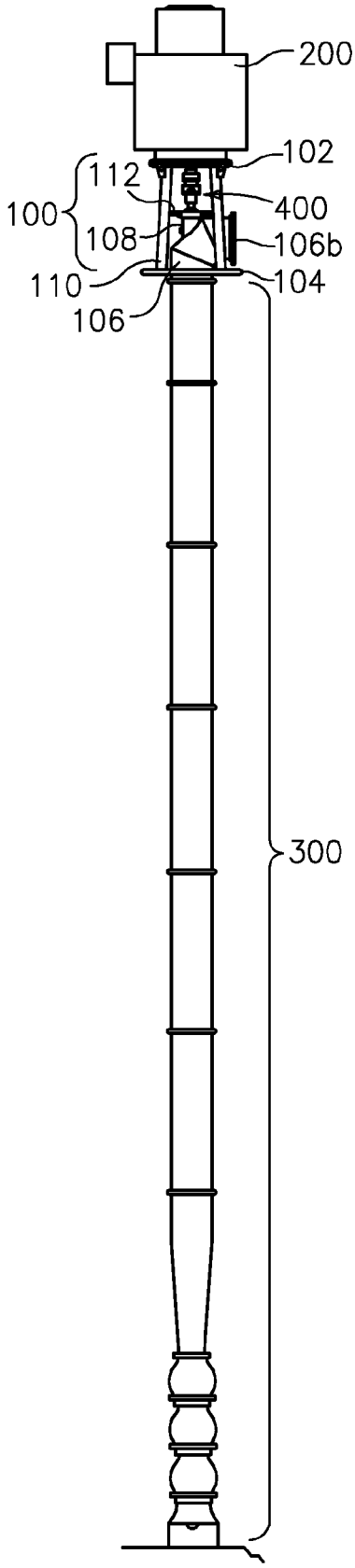
FIGS. 5*a* to 5*d*, shows an assembly drawing of the "O" head design shown in FIGS. 3-4 according to some embodiments of the present invention, where
Figure 5B:
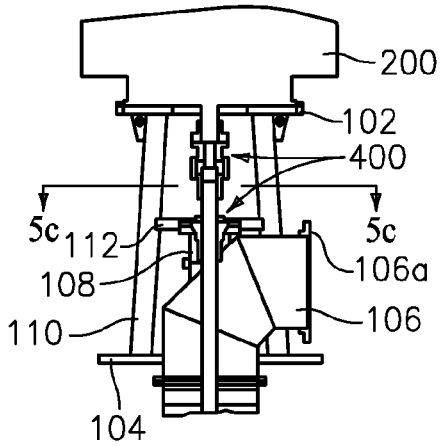
Figure 5C:
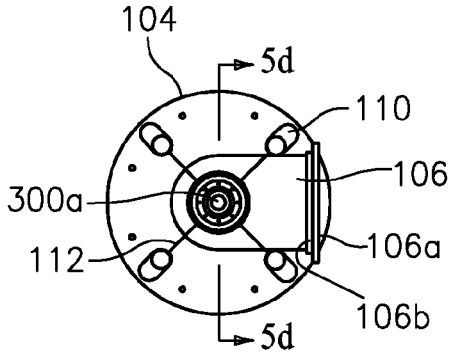
Figure 5D:
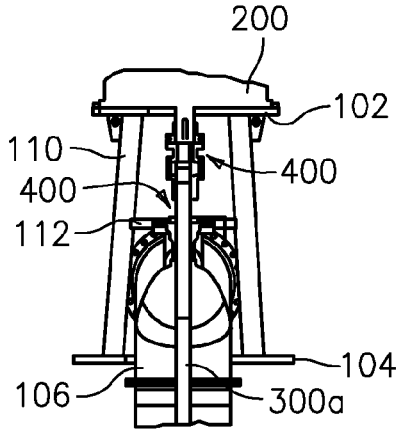

FIGS. 3-5 show, by way of example, an "O" head design for a discharge head generally indicated as 100 according to some embodiments of the present invention.

The discharge head 100 feature a motor mounting plate 102 configured for mounting on or to a motor 200 (see FIG. 5); a base plate configured for mounting on or to a pump assembly generally indicated as 300 in FIG. 5; an elbow transition 106 mounted on the base plate 104 configured for providing discharge from the pump assembly 300; a seal housing pipe 108 coupled to the elbow transition 106 configured for receiving a mechanical seal or packing arrangement generally indicated as 400; supporting pipes 110 arranged between the motor mounting plate 102 and the base plate 104; and ribs 112 arranged between the supporting pipes 110 and the seal housing pipe 108 configured to prevent substantially lateral and torsional movement, including movement due to reacting hydraulic forces at a pump nozzle and inertia from a driver.

The "O" head design according to the present invention may include one or more of the following features:

- Configuration with 4 supporting pipes 110 to support the vertical motor weight, torque, pump downthrust and nozzle forces and moments.
- 360 degree access to the coupling and seal housing: This is significant since it helps field maintenance people to easily remove the coupling and seal components.
- The overall O-head design is for twice nozzle loads per API 610-8$^{Th}$ and 10$^{Th}$ Ed.: This is the most significant change since it involves discharge head stiffness to withstand API forces and moments.
- The overall O-head design is in compliance with API 610-8$^{TH}$ and 10$^{th}$ Ed for Oil & Gas and chemical markets: A major design consideration meets the requirements for ASME section VIII for design and section IX for welding and can be used for multistage vertical pumps at high pressure.
- As shown, the elbow transition 106 is formed as a shorter 3-mitered elbow without welding the ribs to support forces and moments.
- A shorter height length: This improves the overall pump vibration due to less cantilever distance from the foundation to the motor top bearing.
- A less overall vibration amplitude: Achieved from a max relative movement of about 0.003" between the seal housing pipe 108 and the motor mounting plate 102.
- An optimized design configuration: Every job order has a structural static and dynamic analysis performed for specific design conditions that defines the specific configuration using parametric design of the discharge head.
- A small seal housing pipe 108: This feature reduces the amount of hydraulic losses, provides a better hydraulic pressure distribution in the elbow transition, and facilitates the installation of mechanical seal or packing arrangement 400 (FIG. 5).
- A smaller base plate area: The 4-pipe support angle is around 80° vs. 60 to 70° from known competitor's device used for high pressure pump applications.
- A minimum pipe support deflection: Finite Element Analysis (FEA) is performed on each job order to evaluate pipe deflection for optimizing the required cross-section. The additional 4 ribs 112 from the pipe supports 110 to the seal housing pipe 108 are used to prevent lateral and torsional movement due to the reacting hydraulic forces at the pump nozzle and inertia from the driver.
- No need of external ribs: Natural frequency is controlled by performing FEA on each job order and varying the wall thickness of the elbow and pipe supports cross section.
- The elbow transition 106 has a discharge flange 106*a* having a discharge flange weld 106*b* with a butt-weld connection.

The dimensions of the O-head design 100 will depend on the particular application, thus, the scope of the invention is not intended to be limited to any particular set of dimensions. In the provisional application to which this application claims benefit, dimensions were included in FIGS. 5*a* to 5*d* by way of example, but the scope of the present invention is not intended to be limited in any way to the same. In effect, the dimensions form part of a specific design configuration for a particular customer. In view of this, it is understood that embodiments of the present invention are envisioned having dimensions other than that shown in FIGS. 5*a* to 5*d* of the provisional application.

Discharge Head Optimization Tool Process

Figure 6A:
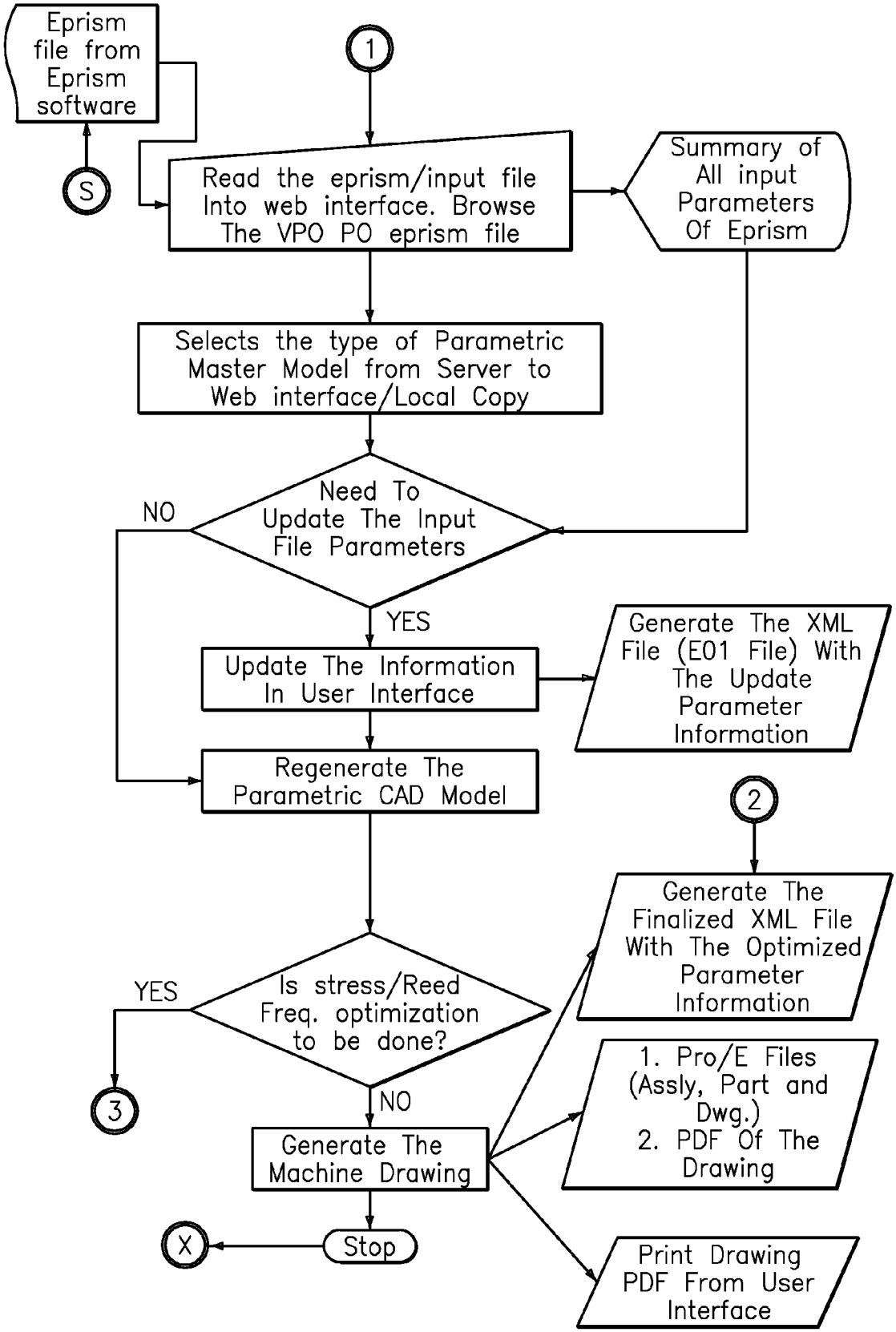
Figure 6B:
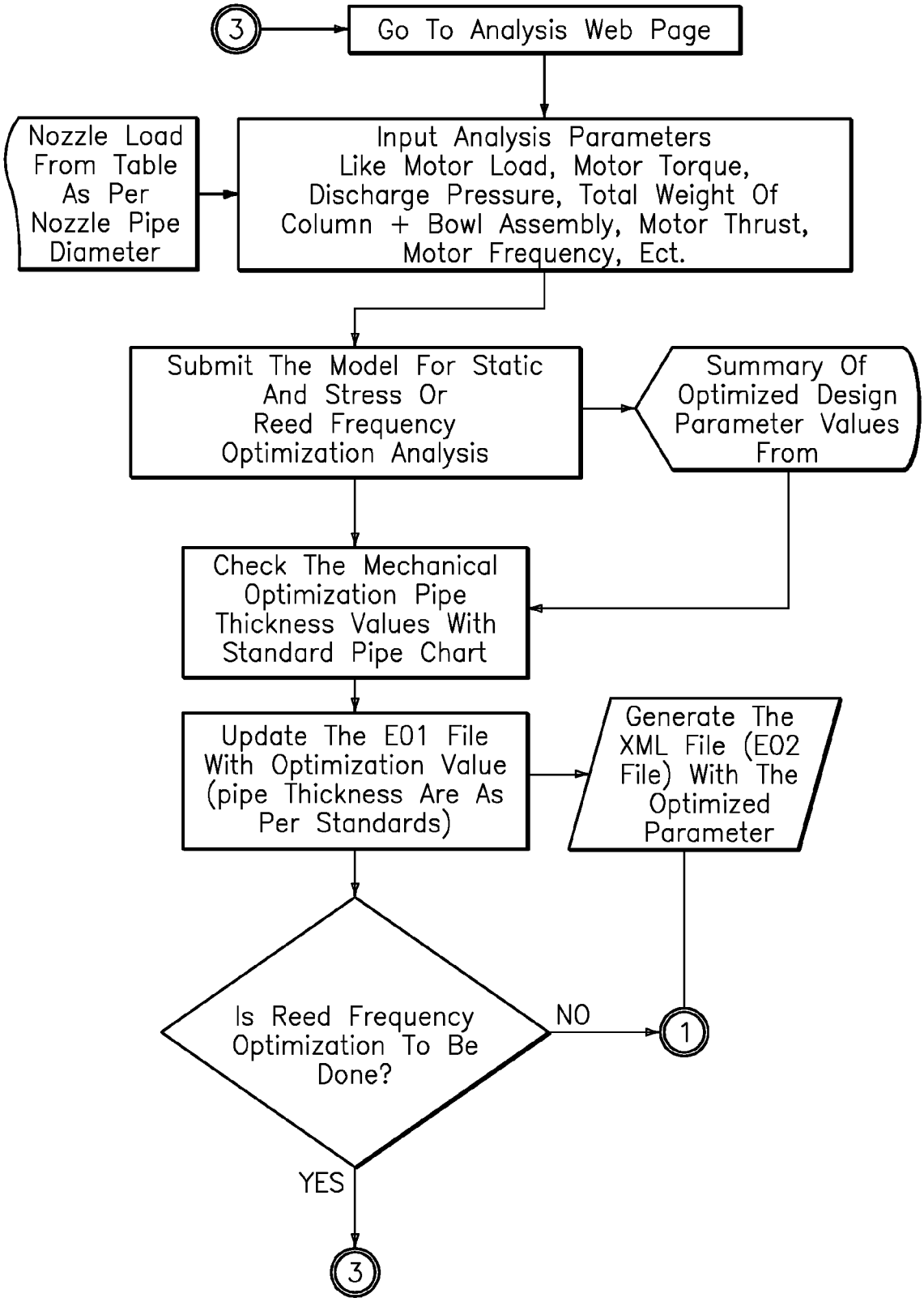

FIG. 6 shows a chart having steps for a discharge head optimization process in FIGS. 6*a*-6*c* which may be used for designing the discharge head shown and described in relation to FIGS. 3-5.

By way of example, a description of a discharge head optimization process, which would be appreciated by a person skilled in the art, is as follows:

The process of optimization tool (OT) may be done in four major steps:

1. Eprism Phase
2. OT Configuration
3. OT Analysis & Optimization
4. OT Drawing Generation Eprism Phase:

The start point of the optimization tool is from Eprism, which is a Java-based application known in the art, when the application engineer completes the pump selection based on hydraulic conditions. It is important to note that the scope of the invention is not intended to be using only the Eprism application, since embodiments are envisioned using other types or kinds of such optimization programs either now known or later developed in the future. Eprism has a built-in link through which the application engineer triggers the optimization tool application by passing eprism XML file. The Eprism XML file contains data like discharge size, hydro test pressure, design type, motor BD, many more dimension details for head design. This information is published into Eprism from a previous job and standard drawings using an 80-20 rule. When the XML file is generated, then the optimization tool application will open through Internet explorer. The optimization tool and Eprism are independent in operation from this point.

OT Configuration:

The XML file generated from Eprism will be stored in a local computer under C:\Documents and Settings\username\PrismTemp\ePrism_Proe*.xml. One can click on "Save As" button in the configuration page. This action brings up a master parametric 3D computer aided design (CAD) model (Pro/E Wildfire2.0) from a master directory to a user directory (user model) in the server itself which will be further changed as per requirement using XML file. Once the model is copied into the directory, the tool updates the Pro/E model parameters in the user model as per the XML file values. The 3D parametric CAD model is built using VPO design guidelines for fabrications like welds, pipe sizes, thickness, plate overhang, etc. Pipe thicknesses are established using Sch40 which is a standard/In-stock item. In the case of the O-head, there will be gap of ½" on either side of the discharge pipe and support pipe.

The tool displays the values attained from Eprism xml file to the user in form of a table/drop down. The user has an option to change the parameters if required in the configuration page. One clicks on "Set parameters" button to set the new values into the user 3D CAD model. For example, the user can update the motor BD, flange rating, head design type, etc. If all parameters are set, then the user needs to click on the "Analysis page" of the tool.

The designer can access the tool directly at the point using a login ID and password but typically needs to get the XML file from Eprism through an application engineer by email/folder transfer.

OT Analysis & Optimization:

The OT analysis and optimization is an important phase in the optimization tool and it is the heart of the tool. All analyses are typically done using Pro/Mechanica, although the scope of the invention is not intended to be limited to the same. This phase has five sub-phases 1. Static Analysis
2. Static optimization
3. Reed frequency Analysis
4. Reed Frequency optimization
5. Static Analysis (based on reed frequency model)

Tool displays all loads which will be applied on the head model. The loads considered in the analysis are, e.g. Nozzle loads (commercial, API, etc.), Hydro test pressure, motor weight, motor torque, pump down thrust, column and bowl assembly weight, although the scope of the invention is intended to include other types or kind of loads either now known or later developed in the future. The user has the flexibility to update the load values in the web page. The analysis is done using two different models—Shell & Solid. All application engineers will have access to shell model analysis and the designer will have access to run the analysis using shell or solid models. In general, the shell models take far less time than the solid model. The solid model analysis is typically more accurate when compared to shell, but the shell model is fine tuned such that deviation of results between shell and solid can be minimized.

1. Static Analysis

Tool applies the above mentioned loads on the model and performs the linear static analysis. The tool reviews the following outputs of the model from analysis as per VPO structural analysis guidelines

- All plates' vertical deflections must typically be less than, e.g., about 0.005 in/ft.
- Relative deflection (normal to pump axis) between center plate where mechanical seal mounts and top plate must typically be less than, e.g., about 0.004 inches.
- Maximum shear stress at pipe intersections must typically be below allowable stress based on commercial or API standards.
- Bolt stress must typically be below allowable stress based on commercial or API standards.

A result summary of the analysis is displayed on the web page for review and print. If any of the outputs fail to meet the analysis guidelines, then tool displays a message "Model needs to be optimized". This makes the user to go for a static optimization sub-phase. If the analysis is passed, then user is recommended to perform reed frequency analysis.

2. Static Optimization Analysis:

Tool has pre-defined logic for arriving at optimized model for different scenarios. By way of example, the following is discussed for the O-Head design, a) If any plate fails in the vertical deflection criteria, then tool will automatically increase the existing plate thickness by, e.g. about ⅛" increment and performs static analysis again till the plate deflection meets the criteria.

b) If the max shear stress is exceeding the limit, then nozzle pipe thickness is increased to next pipe thickness using Standard pipe chart.

c) If the relative deflection fails, then the chimney pipe thickness will be increased as Step b. In some cases, the existing pipe may fail using a maximum thickness also, then the tool will upgrade the chimney pipe to the next standard available pipe size with SCH40 pipe thickness. Also design relation is built so that the chimney does not exceed the discharge pipe diameter. Four ribs were provided between the support pipe and center for better stability (less deflection—normal to pump axis)

As the model is parametric, change in chimney pipe diameter will change the center plate outer diameter also automatically retaining the required plate ID for seal housing.

d) If bolt stress fails, then tool will update the bolt diameter and re-runs the analysis. After a certain size, tool resets the bolt size to the original size and tries by increasing the number of bolts. Whenever the bolt size is increased, tool checks for material availability in the plate. If required it updates the plate diameter or bolt circle diameter.

e) If multiple criteria's are failed, then tool will act the above optimization rules in one single run where ever possible to reduce the solution time.

f) The tool runs "N" number of iterations based on complexity and proximity of initial model results to safe zone. After finishing the iterations, then tool arrives at the optimized model with the updated results for review & print.

g) In any case for the given loading conditions, the tool was not able to find an optimum solution, then it will give a pop up to the user recommending "REFER TO FACTORY".

3. Reed Frequency Analysis:

Tool has provisions to enter the motor reed frequency information which is supplied by motor supplier. Tool considers the motor reed frequency in determining the system (head & motor) reed frequency. Analysis guideline followed is, e.g., about +/−25% away from the operating speed. After performing the reed frequency analysis, results are printed with a safety margin for review and print. In case the system frequency falls within +/−25%, then tool recommends the user to go "Reed frequency optimization Analysis".

If the reed frequency is fine, then the user will be allowed to go to final phase—OT Drawing Generation.

4. Reed Frequency Optimization Analysis:

In the case of the O-head, the reed frequency will be altered drastically by changing the support pipe thickness and size. Parametric model takes care of the bottom plate diameter based on the support pipe diameter and sump opening. Always the support pipe must have a rigid support to its bottom so pipe supports are located at bottom plate based on sump opening diameters.

Once the model is optimized for reed frequency conditions, then tool will perform final run of static analysis.

5. Static Analysis (Step 4 Model) Analysis

Before the generating the drawing, the tool runs again a static analysis if there is a change in the model based on the reed frequency analysis (Step 3 & 4). This step ensures the final optimized model undergone both static and reed frequency analysis. If anything fails, then the process will be repeated with this model from Step 1, or else the user will be allowed to go to final phase—OT Drawing Generation.

OT Drawing Generation:

Tool generates the fabrication drawing for the discharge head based on the optimized model in PDF format with options of "Open"/"Save" to users computer.

For Application engineers, drawing list the material for components based on XML file or configuration inputs. Also on the drawing, "DRAWING FOR QUOTE ONLY" message is displayed to make sure that it is not released to manufacturing.

For design engineers, a material list will not be shown because material details will be shown on BM. Drawing for quote only will not be displayed.

The aforementioned description and the chart shown in FIG. 6 are provided by way of example only. The scope of the invention is intended to include other types or kinds of optimization processes either now known or later developed in the future, which may be used for designing the discharge head shown and described in relation to FIGS. 3-5, as well as other types and kinds of discharge heads for other types and kinds of applications, all within the spirit of the present invention, as would be appreciated by a person skilled in the art.

The Scope Of The Invention

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

What is claimed is:

1. A discharge head for high pressure pump applications, comprising:

a motor mounting plate configured for mounting on or to a motor;

a base plate configured for mounting on or to a pump assembly;

an elbow transition mounted on the base plate and configured between the base plate and the motor mounting plate for providing discharge from the pump assembly;

a seal housing pipe configured to partially extend from the elbow transition towards the motor mounting plate, to receive a mechanical seal or packing arrangement and to provide 360 degree access to the mechanical seal or packing arrangement;

four supporting pipes configured to couple the motor mounting plate and the base plate;

four ribs configured to couple the four supporting pipes and the seal housing pipe and to prevent substantially lateral and torsional movement, including movement due to reacting hydraulic forces at a pump nozzle and inertia from a driver;

the discharge head being configured to have a base plate area, configured so that the discharge head has a pipe support angle that is around 80° versus 60 to 70° from a known device used for high pressure pump applications; and the discharge head also being configured to have an overall vibration amplitude achieved from a max relative movement of about 0.003" between the seal housing pipe and the motor mounting plate so as to substantially increase motor stand structure stiffness and maximum nozzle flange pressure ratio.

2. A discharge head according to claim 1, wherein the four support pipes are configured to support a vertical motor weight, torque, pump downthrust and nozzle forces and moments.

3. A discharge head according to claim 1, wherein the discharge head is configured to form part of a multistage vertical pump at high pressure.

4. A discharge head according to claim 1, wherein the discharge head is configured to have a 3-mitered elbow without welding ribs to support forces and moments.

5. A discharge head according to claim 1, wherein the discharge head is configured to have a shorter height length so as to improve the overall pump vibration due to less cantilever distance from the foundation to the motor top bearing.

6. A discharge head according to claim 1, wherein each component, including the mounting plate, base plate, elbow transition, seal housing pipe, supporting pipe and additional ribs, of the discharge head is configured to have an optimized design configuration, the dimensions of which are generated by performing a structural static and dynamic analysis for specific design conditions that defines a specific configuration using parametric design of the discharge head.

7. A discharge head according to claim 1, wherein the discharge head is configured to have a seal housing pipe dimensioned so as to reduce the amount of hydraulic losses, provide a better hydraulic pressure distribution in the elbow transition and facilitates the installation of the mechanical seal or packing arrangement.

8. A discharge head according to claim 1, wherein the discharge head is configured to have a minimum pipe support deflection by performing Finite Element Analysis (FEA) during its design to evaluate pipe deflection optimizing the required cross-section.

9. A discharge head according to claim 1, wherein the ribs include four additional ribs each connected from a respective one of four pipe supports to the seal housing pipe.

10. A discharge head according to claim 1, wherein the discharge head is configured without external ribs, based at least partly on the natural frequency of the discharge head being controlled by performing Finite Element Analysis (FEA) during its design and varying the wall thickness of the cross section of elbow transition and pipe supports.

11. A discharge head according to claim 1, wherein the elbow transition is configured with a discharge flange having a discharge flange weld with a butt-weld connection.

* * * * *